US006923582B2

(12) United States Patent
Pomfret

(10) Patent No.: US 6,923,582 B2
(45) Date of Patent: Aug. 2, 2005

(54) INKED RIBBON CORE

(75) Inventor: John A. Pomfret, East Lyme, CT (US)

(73) Assignee: Cartec International, Inc., Canton, CT (US)

( * ) Notice: Subject to any disclaimer, the term of this patent is extended or adjusted under 35 U.S.C. 154(b) by 0 days.

(21) Appl. No.: 10/691,288

(22) Filed: Oct. 21, 2003

(65) Prior Publication Data

US 2005/0084309 A1 Apr. 21, 2005

(51) Int. Cl.[7] ..... B65H 75/18
(52) U.S. Cl. ..... 400/242; 242/597.6; 242/611.2
(58) Field of Search ..... 400/207, 208, 400/242, 613; 242/597.5, 597.6, 611.1, 611.2

(56) References Cited

U.S. PATENT DOCUMENTS 5,833,377 A * 11/1998 Keller et al. ..... 400/208
6,425,551 B1 * 7/2002 Puckett et al. ..... 242/611.2
6,609,677 B2 * 8/2003 Seybold et al. ..... 242/611.2

* cited by examiner

*Primary Examiner*—Stephen R. Funk
(74) *Attorney, Agent, or Firm*—Ira S. Dorman

(57) ABSTRACT

An inked ribbon core has an internal collar and a longitudinal rib which frictionally engage corresponding spindle structures to thereby secure the core in its fully mounted position, as determined by a stop ring.

24 Claims, 1 Drawing Sheet

FIG. 1
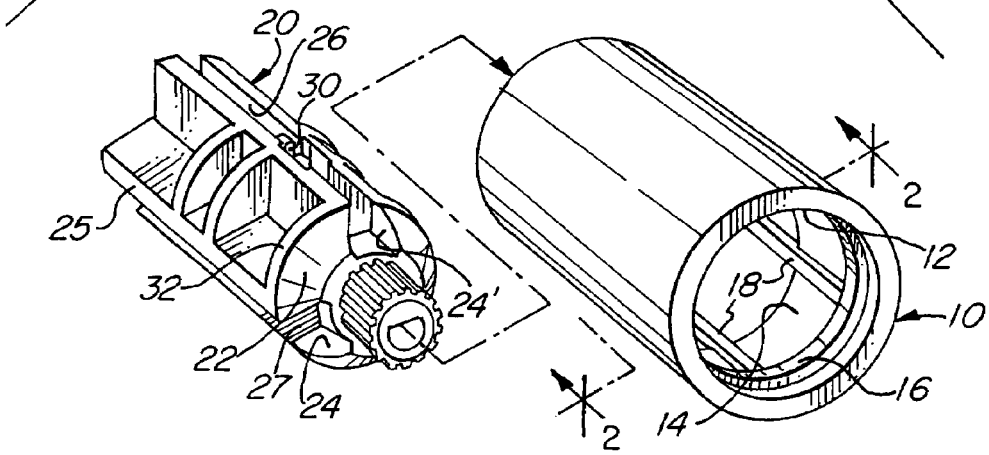
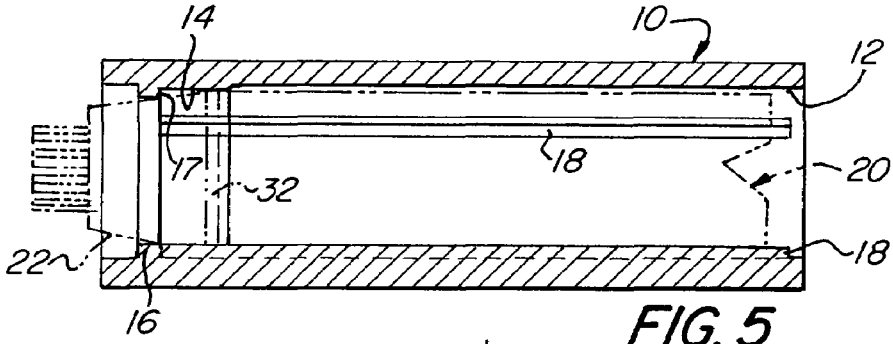
FIG. 5
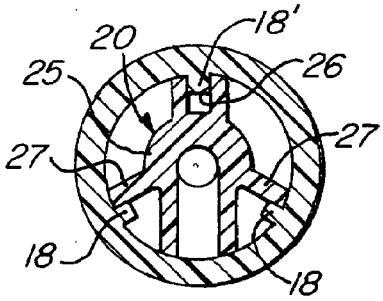
FIG. 2
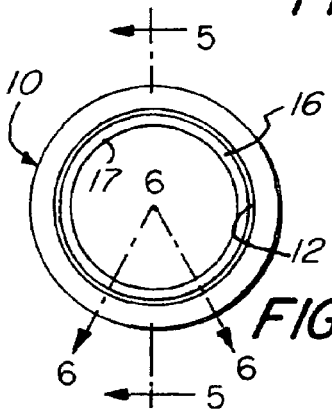
FIG. 3
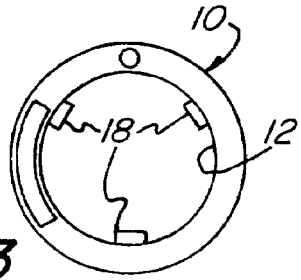
FIG. 4
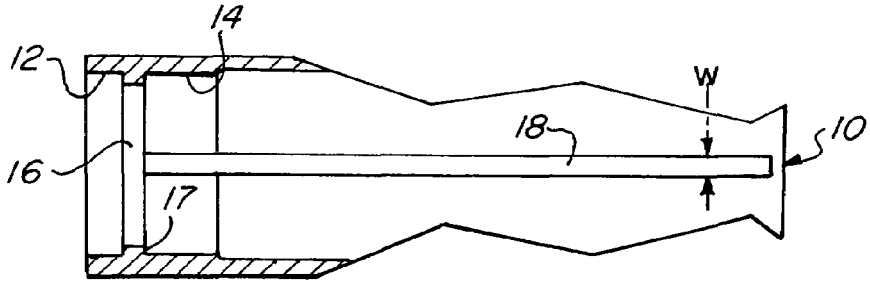
FIG. 6

INKED RIBBON CORE

BACKGROUND OF THE INVENTION

Printing machines of the kind described for example in Keller et al. U.S. Pat. No. 5,833,377 utilize a thermal transfer "inked" ribbon wound upon a core, the core in turn being mounted upon a spindle of the machine (see for example FIG. 4 of the patent). The spindle may have a plurality of longitudinal grooves and/or walls that engage corresponding ribs on the inside of the core to lock the core against relative rotation on the spindle. The spindle and core may also have cooperating means for limiting the depth to which the spindle can be inserted into the core, and for maintaining the core in its fully mounted position. The limiting and securing means described by Keller et al. take the form of a ramp and stop face, centrally located on the ribs of the core, which coact, respectively, with an abutment and a resilient spring finger disposed in a groove of the spindle.

SUMMARY OF THE INVENTION

Despite extensive prior art activity and the commercial availability of a considerable variety of suitable products, a need remains for an inked ribbon core, generally of the kind disclosed by Keller et al. but that is improved thereupon in at least certain resepcts, that is of incomplex and economical construction, that is readily mounted upon and dismounted from printer spindles of various forms, and that enables reliable and stable positioning of the core on the spindle while affording secure support for the inked ribbon wound thereupon. Accordingly, the broad objects of the invention are to provide a ribbon core having the foregoing features and advantages, and a core and spindle assembly utilizing the same.

It has now been found that certain of the foregoing and related objects of the invention are attained by the provision of a spindle-mountable core comprising a tubular body having an outer surface for receiving and supporting a length of web material wound thereupon, and a generally cylindrical inner surface defining a bore through the body for receiving a spindle inserted from the aft end (i.e., the end of the core closet to the printer, as mounted). A plurality of circumferentially spaced ribs extend axially along the bore, and radially inwardly from the inner surface of the body, for slidable engagement in or against corresponding groove structure on the outer surface of a mounting spindle, each rib preferably being of uniform circumferential width along its entire length. Stop means is provided on the core for engaging the spindle, so as to limit the depth of insertion and thereby define a fully mounted position, and collar structure on the inside surface of the body, circumscribing the bore, constitutes an interference band having a contact surface with an effective inside diameter smaller than the diameter of the major portion of the bore. The collar structure is disposed near the fore end of the bore and serves, in the fully mounted core position, to frictionally engage circumferential contact means on the spindle.

The collar structure (and its contact surface) will normally be circumferentially continuous and of substantially uniform radial thickness. The stop means will usually comprise an engagement element operatively disposed between the collar structure and the fore end of the bore, preferably providing a circumferential shoulder disposed radially inwardly of the contact surface of the collar structure and most desirably taking the form of ring structure on the inside surface of the body, effectively circumscribing the bore adjacent the fore end; the ring structure will normally be of substantially uniform radial thickness, greater than the thickness of the collar structure.

Other objects of the invention are attained by the provision of an assembly comprised of an elongate spindle and a web material-supporting core, constructed as herein described. The spindle includes a shaft portion having groove structure (i.e., either a slot defined by two parallel walls, or a single wall) that opens forwardly and radially outwardly, and a forward end portion having circumferentially disposed external contact means thereon. The ribs on the core are slidably engaged in or against the groove structure of the spindle, and the stop means on the core engages the spindle so as to limit the depth of insertion; the collar structure on the inside surface of the body frictionally engages the circumferential contact means on the spindle, for retention of the core in its fully mounted position.

In preferred embodiments of the assembly the groove structure on the spindle defines at least one slot, and at least one of the ribs on the core is dimensioned to frictionally engage corresponding slot-defining structure on the spindle, so as to cooperate with the collar structure and spindle contact means for maintaining the fully mounted position of the core. The ribs will normally be of uniform circumferential width along their entire length, and the groove structure will normally extend through the forward end portion of the spindle, as well as along the shaft portion. Typically, the cooperating rib and slot-defining structure, and the cooperating collar structure and spindle contact means, will function together to provide a holding force of about 4 to 6 pounds for retaining the core against axial displacement on the spindle.

BRIEF DESCRIPTION OF THE DRAWINGS

FIG. 1 is an exploded perspective view showing the components of an inked ribbon roll-supporting assembly embodying the present invention;

FIG. 2 is a sectional view, taken along line 2—2 of FIG. 1, showing the core of the assembly, fully mounted on the spindle;

FIG. 3 is a fore end view of the core of the foregoing figures, rotated 180°;

FIG. 4 is an aft end view of the core;

FIG. 5 is a sectional view of the core, taken along line 5—5 in FIG. 3 and additionally showing, in phantom line, the mounting spindle; and FIG. 6 is a fragmentary sectional view taken along line 6—6—6 in FIG. 3.

DETAILED DESCRIPTION OF THE PREFERRED AND ILLUSTRATED EMBODIMENT

Turning now in detail to the appended drawings, it is seen that the ribbon-supporting core of the present invention consists of a cylindrical body, generally designated by the numeral 10, having a bore 12 extending from end-to-end therethrough. The bore is of constant diameter along most of its length, but a short, reduced-diameter axial section, adjacent the fore end of the core, provides an integral collar or interference band 14. A ring-like element 16, contiguous to the fore end of the collar 14, provides a stop for limiting the depth to which a printer spindle can be inserted into the bore 12. Three ribs 18 extend, at equiangularly spaced (120°)

circumferential locations, from adjacent the aft end of the body 10 to the stop ring 16; they are of constant width along their entire length.

As is best seen in FIG. 1, the spindle consists of a body, generally designated by the numeral 20, having a frustoconical leading end portion 22 through which extend three slots 24 (only two of which are visible), disposed at 120° circumferentially spaced positions. One of the slots 24' continues as an elongate channel 26, extending axially along the length of the spindle shaft portion 25; the other two slots 24 lead to longitudinal wall elements 27. An abutment 30 and a resilient spring finger (not visible) are disposed in the channel 26, and are provided to cooperate with the core disclosed in the above-identified Keller et al. patent; they serve no purpose in the assembly of the present invention.

As is best seen in FIGS. 2 and 5, the core is mounted on the spindle with one of the ribs 18' seated in the channel 26, the rib being of such constant width "W" that it engages the lateral wall elements defining the channel 26 with a significant level of friction, thereby producing a retentive force that resists relative axial movement of the core on the shaft. The remaining two ribs 18 bear upon the walls 27 of the shaft, and serve primarily to guide the core onto the shaft and to stabilize it in position.

An additional component of holding force is generated by engagement of the circumferential contact surface elements 32, which discontinuously (i.e., as arcuate segments) surround the base of the frustoconical leading end portion 22 of the spindle, upon the collar 14 of the core. As will be appreciated, the radial thickness of the collar 14 is such that it grips the circumferential surface elements 32 on the spindle to produce substantial resistance to relative movement, especially under the compressive force of a ribbon would tightly upon the core; indeed, the relative dimensions are such that discernable expansion occurs at the collar when the spindle surface elements bear thereagainst.

The ring-like stop element 16 provides a circumferential edge 17, disposed radially inwardly of the interference band 14, that engages the frustoconical surface 22 of the leading end portion of the spindle (in circular line contact), thereby determining the depth to which the spindle can be inserted into the core. Needless to say, the position and dimensions of the ring-like element 16 are such that inter-engagement occurs when the surface elements 32 bear fully upon the interference band 14.

In a specific embodiment of the invention, the ribbon core is constructed for use in a Monarch 9800 printer (Monarch Marking Systems, Inc.). For that application, the body of the core is about 4.3 inches long and about 1.5 inches in outside diameter, with a bore diameter of about 1.15 inches extending along most of the length of the body. The stop ring is positioned about 0.21 inch from the fore end of the core body, and has an axial length of about 0.12 inch and an inside diameter of about 1.0 inch. The gripping collar extends about 0.4 inch beyond the ring element, to the aft side, and has an inside diameter (in unstressed state) of about 1.12 inch. The ribs on the core body are about 0.13 inch in circumferential width and extend from adjacent the stop ring to a point approximately 0.07 inch from the aft end of the body; the top surfaces of the ribs lie in an imaginary cylinder of about 0.98 inch diameter. Normally, the core will be fabricated from a synthetic resinous material, such as ABS copolymer, nylon, high impact polystyrene, or the like.

It will be appreciated that variations in the form and dimensions of the core of the invention, and of a spindle used in assembly therewith, may be made without departing from the scope of the appended claims. Although the core is intended primarily for use with an inked ribbon roll in a printing machine, it will be appreciated that other web material may be wound upon the core for discharge and take-up, and for other applications, as may be appropriate.

Thus, it can be seen that the present invention provides a novel inked ribbon core, for use with a printing machine, that is of incomplex and economical construction, is readily mounted upon and dismounted from spindles of various forms, and that nevertheless enables reliable and stable positioning on the printer spindle while affording secure support for the ribbon wound thereupon. The invention also provides a novel core/spindle assembly affording such features and advantages.

Having thus described the invention, what is claimed is:

1. A spindle-mountable core for supporting a roll of web material, comprising:

a tubular body having an outer surface for receiving and supporting a length of web material wound thereupon, and having a generally cylindrical inner surface defining a bore through said body for receiving a spindle inserted thereinto from one end, a major portion of said bore having a first diameter;

a plurality of circumferentially spaced ribs extending axially along said bore and radially inwardly from said inner surface of said body, said ribs being constructed for slidable engagement with corresponding groove structure formed into the outer surface of a mounting spindle;

stop means on said core for engaging a spindle inserted into said bore through said body from said one end so as to limit the depth of insertion of the spindle and thereby define a fully mounted position of said core thereon; and collar structure on said inner surface of said body effectively circumscribing said bore and having a contact surface with an effective inside diameter smaller than said first diameter, said collar structure being disposed near the end of said bore opposite to said one end and presenting said contact surface thereof for frictional engagement with circumferential contact means on a spindle in said fully mounted position of said core thereon.

2. The core of claim 1 wherein said collar structure and said contact surface thereof are circumferentially continuous.

3. The core of claim 1 wherein said collar structure is of substantially uniform radial thickness.

4. The core of claim 1 wherein said stop means comprises an engagement element operatively disposed between said collar structure and said opposite end of said bore.

5. The core of claim 4 wherein said engagement element comprises a circumferential shoulder disposed radially inwardly of said contact surface of said collar structure.

6. The core of claim 5 wherein ring structure on said inner surface of said body effectively circumscribes said bore adjacent said opposite end thereof, said ring structure being of substantially uniform thickness, greater than the thickness of said collar structure, and providing said circumferential shoulder.

7. The core of claim 1 wherein each of said ribs is of a uniform circumferential width along its entire length.

8. An assembly for supporting a roll of web material, comprising an elongate spindle comprised of a shaft portion and a forward end portion having circumferentially disposed external contact means thereon, said spindle having a plurality of groove structures that extend axially along at least said shaft portion and that open forwardly and radially outwardly thereof; and a core, for supporting a roll of web material, disengageably mounted on said spindle, said core comprising:

a tubular body having an outer surface for receiving and supporting a length of web material wound thereupon, and having a generally cylindrical inner surface defining a bore through said body for receiving said spindle inserted thereinto from one end, a major portion of said bore having a first diameter;

a plurality of circumferentially spaced ribs extending axially along said bore and radially inwardly from said inner surface of said body, said ribs being constructed for slidable engagement with said groove structure of said spindle and being so engaged;

stop means on said core for engaging said spindle so as to limit the depth to which said spindle can be inserted into said bore through said body from said one end, thereby defining a fully mounted position of said core thereon; and collar structure on said inner surface of said body effectively circumscribing said bore and having a contact surface thereon with an effective inside diameter smaller than said first diameter, said collar structure being disposed near the end of said bore opposite to said one end, and said contact surface thereof frictionally engaging said circumferentially disposed external contact means on said spindle for retention of said core in said fully mounted position of said core thereon.

9. The assembly of claim 8 wherein said collar structure and said contact surface thereof are circumferentially continuous.

10. The assembly of claim 8 wherein said collar structure is of substantially uniform radial thickness.

11. The assembly of claim 8 wherein said stop means comprises an engagement element operatively disposed between said collar structure and said opposite end of said bore.

12. The core of claim 11 wherein said engagement element comprises a circumferential shoulder disposed radially inwardly of said contact surface of said collar structure.

13. The assembly of claim 12 wherein ring structure on said inner surface of said body effectively circumscribes said bore adjacent said opposite end thereof, said ring structure being of substantially uniform thickness, greater than the thickness of said collar structure, and providing said circumferential shoulder.

14. The assembly of claim 8 wherein said groove structure defines at least one slot, and wherein at least one of said ribs is dimensioned to frictionally engage the one slot-defining groove structure of said spindle in which said one rib is engaged, said one rib and said one slot-defining groove structure cooperating with said collar structure and said external contact means for retention of said core on said spindle in said fully mounted core position.

15. The assembly of claim 14 wherein said core is retained on said spindle, against axial displacement, with a holding force of about 4 to 6 pounds.

16. The assembly of claim 14 wherein said at least one rib is of uniform circumferential width along its entire length.

17. An assembly for supporting a roll of web material, comprising an elongate spindle comprised of a shaft portion and a forward end portion having circumferentially disposed external contact means thereon, said spindle having a plurality of groove structures that extend axially along at least said shaft portion and that open forwardly and radially outwardly thereof; and a core, for supporting a roll of web material, disengageably mounted on said spindle, said core comprising:

a tubular body having an outer surface for receiving and supporting a length of web material wound thereupon, and having a generally cylindrical inner surface defining a bore through said body for receiving said spindle inserted thereinto from one end, a major portion of said bore having a first diameter;

a plurality of circumferentially spaced ribs extending axially along said bore and radially inwardly from said inner surface of said body, said ribs being constructed for slidable engagement in said groove structure of said spindle and being so engaged;

stop means on said core for engaging said spindle so as to limit the depth to which said spindle can be inserted into said bore through said body from said one end, thereby defining a fully mounted position of said core thereon; and collar structure on said inner surface of said body effectively circumscribing said bore and having a contact surface thereon with an effective inside diameter smaller than said first diameter, said collar structure being disposed near the end of said bore opposite to said one end, and said contact surface thereof frictionally engaging said circumferentially disposed external contact means on said spindle for retention of said core in said fully mounted position of said core thereon; said groove structure of said spindle defining at least one slot, and at least one of said ribs of said core being dimensioned to frictionally engage the one slot-defining groove structure of said spindle, in which said one rib is engaged, to thereby cooperate with said collar structure and said external contact means for retention of said core on said spindle in said fully mounted core position.

18. The assembly of claim 17 wherein said core is retained on said spindle, against axial displacement, with a holding force of about 4 to 6 pounds.

19. The assembly of claim 17 wherein said at least one rib is of uniform circumferential width along its entire length.

20. The assembly of claim 17 wherein said collar structure and said contact surface thereof are circumferentially continuous.

21. The assembly of claim 17 wherein said collar structure is of substantially uniform radial thickness.

22. The assembly of claim 17 wherein said stop means comprises an engagement element operatively disposed between said collar structure and said opposite end of said bore.

23. The assembly of claim 22 wherein said engagement element comprises a circumferential shoulder disposed radially inwardly of said contact surface of said collar structure.

24. The assembly of claim 23 wherein ring structure on said inner surface of said body effectively circumscribes said bore adjacent said opposite end thereof, said ring structure being of substantially uniform thickness, greater than the thickness of said collar structure, and providing said circumferential shoulder.

* * * * *